US006341786B1

(12) United States Patent
Kermis

(10) Patent No.: US 6,341,786 B1
(45) Date of Patent: Jan. 29, 2002

(54) SKI BOARD APPARATUS

(76) Inventor: Paul C. Kermis, 137 Pacer Dr., Henrietta, NY (US) 14467

( * ) Notice: Subject to any disclaimer, the term of this patent is extended or adjusted under 35 U.S.C. 154(b) by 0 days.

(21) Appl. No.: 09/466,094

(22) Filed: Dec. 17, 1999

(51) Int. Cl.[7] ..... A63C 5/00; A63C 5/04
(52) U.S. Cl. ..... 280/14.22; 280/22.1
(58) Field of Search ..... 280/14.21, 14.22, 280/14.24, 14.25, 14.26, 14.1, 623, 626, 628, 629, 22.1, 13; 441/70, 74, 75

(56) References Cited

U.S. PATENT DOCUMENTS

| | | | | | |
|---|---|---|---|---|---|
| 2,740,972 | A | * | 4/1956 | Taylor | 9/21 |
| 3,127,623 | A | * | 4/1964 | Roudebush | 9/310 |
| 4,161,324 | A | | 7/1979 | Colvin | |
| 4,194,753 | A | | 3/1980 | Schrishuhn, Jr. | |
| 4,221,394 | A | * | 9/1980 | Campbell | 280/14.2 |
| 4,784,233 | A | | 11/1988 | Favors | |
| 4,871,337 | A | * | 10/1989 | Harris | 441/70 |
| 4,969,655 | A | * | 11/1990 | Katz | 280/14.2 |
| 5,021,017 | A | * | 6/1991 | Ott | 441/70 |
| 5,161,810 | A | | 11/1992 | De Cesare | |
| 5,249,816 | A | | 10/1993 | Southworth | |
| 5,553,883 | A | * | 9/1996 | Erb | 280/607 |
| 5,613,695 | A | * | 3/1997 | Yu | 280/14.2 |
| D391,613 | S | | 3/1998 | Shannon | |
| 5,810,370 | A | * | 9/1998 | Covert et al. | 280/14.2 |
| 5,975,546 | A | * | 11/1999 | Strand | 280/87.042 |
| 5,984,324 | A | * | 11/1999 | Wariakois | 280/14.2 |
| 6,015,161 | A | * | 1/2000 | Carlson | 280/626 |
| 6,089,581 | A | * | 7/2000 | Partridge | 280/14.2 |

* cited by examiner

*Primary Examiner*—Brian L. Johnson
*Assistant Examiner*—Bridget Avery

(57) ABSTRACT

A ski board apparatus for ski boarding down a slope. The ski board apparatus includes a board for supporting a user. The board has a top surface, a bottom surface, a front edge, a back edge, a first side edge and second side edge. Two pairs of elongate runners each have a tapered end portion. Each of the tapered end portions is turned upwards out of a plane of the runners. A pair of mountings mount the runners to the board. One pair of runners is located in front of a second pair of runners such that one of the runners from a front pair of the runners generally shares a longitudinal axis with one of the runners of a rear pair of the runners, wherein a front pair of runners and a back pair of runners are defined.

6 Claims, 3 Drawing Sheets

FIG 3
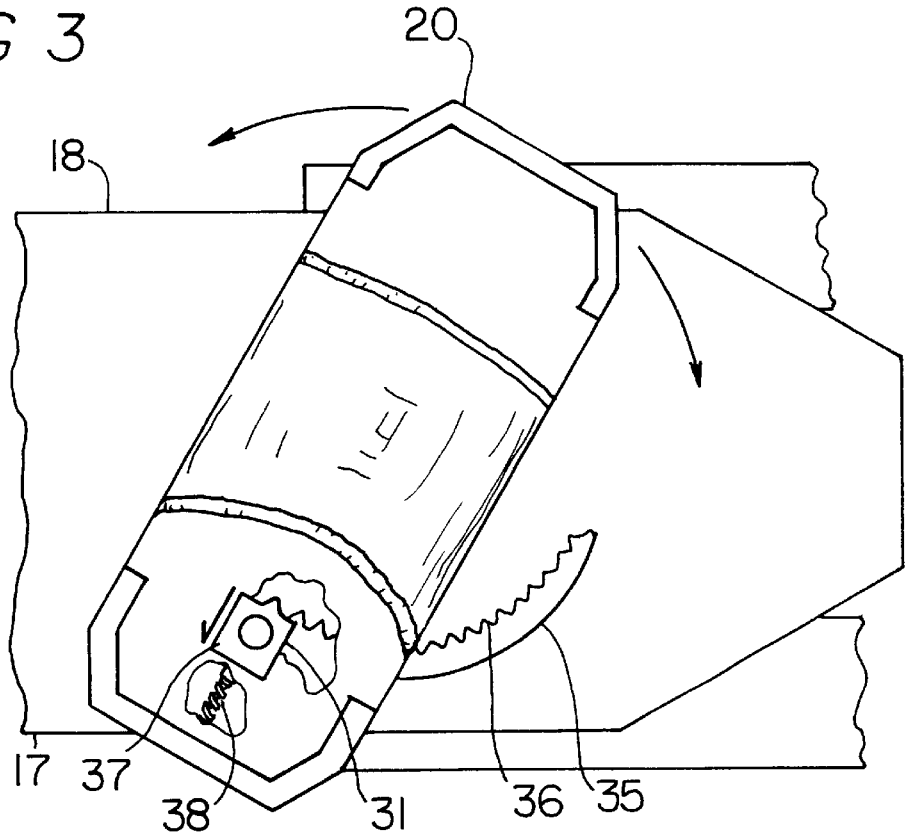
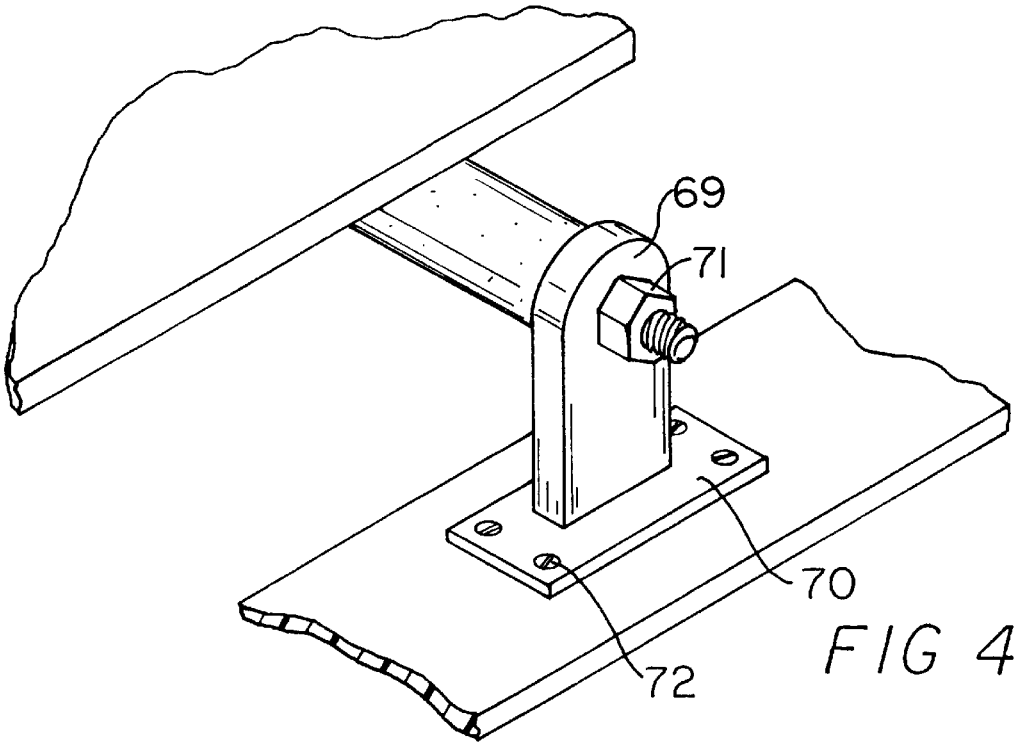
FIG 4

FIG 5
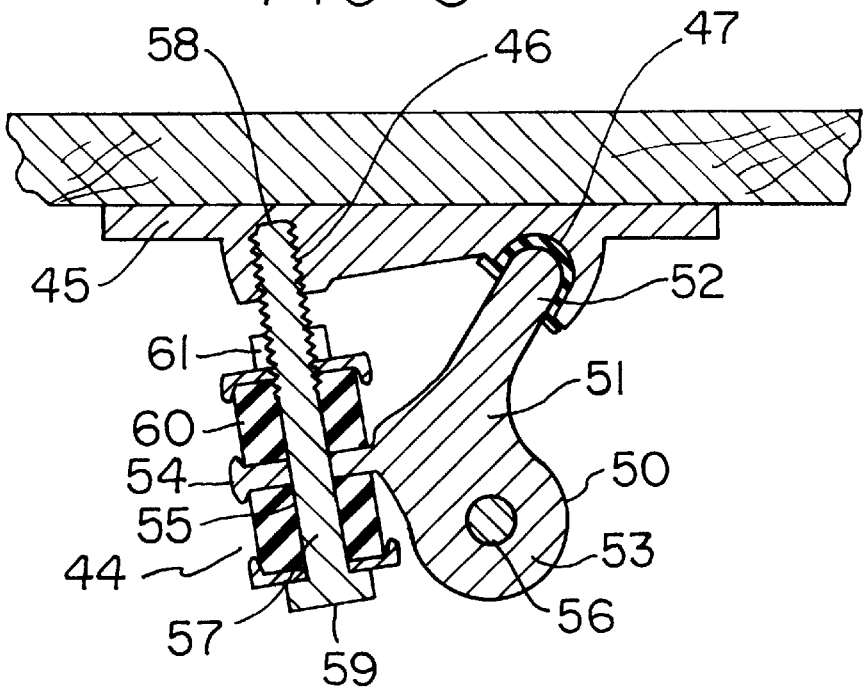
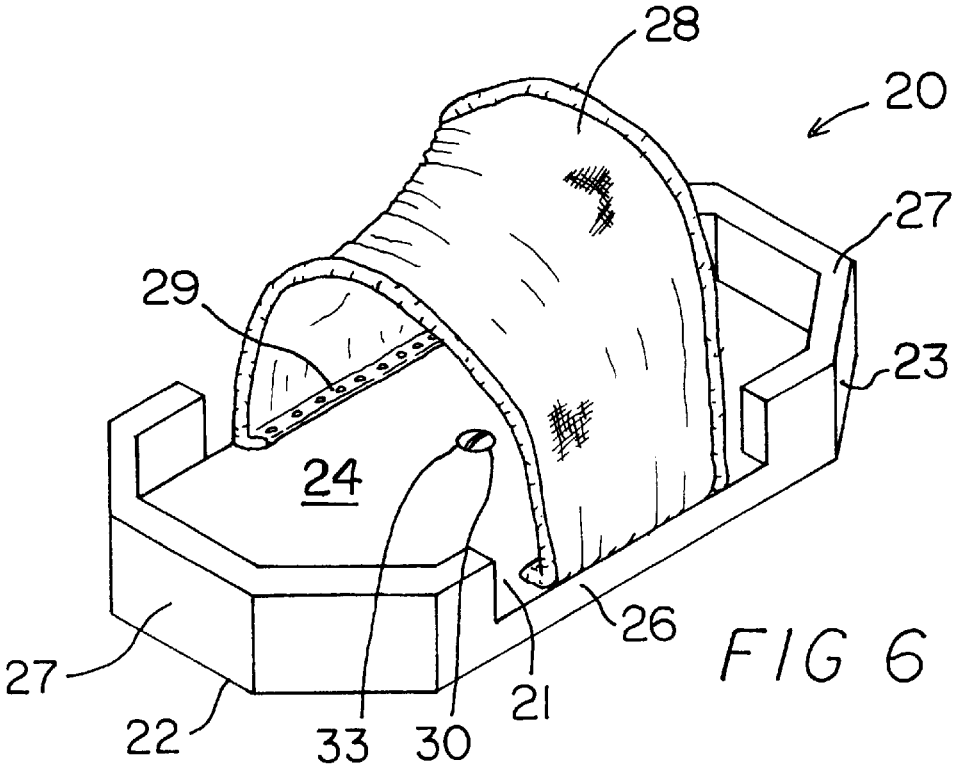
FIG 6

SKI BOARD APPARATUS

BACKGROUND OF THE INVENTION

1. Field of the Invention

The present invention relates to ski boards and more particularly pertains to a new ski board apparatus for ski boarding down a slope.

2. Description of the Prior Art

The use of ski boards is known in the prior art. More specifically, ski boards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,249,816; U.S. Pat. No. 4,161,324; U.S. Pat. No. 4,194,753; U.S. Pat. No. 5,161,810; U.S. Pat. No. 4,784,233; and U.S. Des. Pat. No. 391,613.

While these devices fulfill their respective, particular objectives and requirements, the aforementioned patents do not disclose a new ski board apparatus. The inventive device includes a board for supporting a user. The board has a top surface, a bottom surface, a front edge, a back edge, a first side edge and second side edge. Two pairs of elongate runners each have a tapered end portion. Each of the tapered end portions is turned upwards out of a plane of the runners. A pair of mountings mount the runners to the board. One pair of runners is located in front of a second pair of runners such that one of the runners from a front pair of the runners generally shares a longitudinal axis with one of the runners of a rear pair of the runners, wherein a front pair of runners and a back pair of runners are defined.

In these respects, the ski board apparatus according to the present invention substantially departs from the conventional concepts and designs of the prior art, and in so doing provides an apparatus primarily developed for the purpose of ski boarding down a slope.

SUMMARY OF THE INVENTION

In view of the foregoing disadvantages inherent in the known types of ski boards now present in the prior art, the present invention provides a new ski board apparatus construction wherein the same can be utilized for ski boarding down a slope.

The general purpose of the present invention, which will be described subsequently in greater detail, is to provide a new ski board apparatus apparatus and method which has many of the advantages of the ski boards mentioned heretofore and many novel features that result in a new ski board apparatus which is not anticipated, rendered obvious, suggested, or even implied by any of the prior art ski boards, either alone or in any combination thereof.

To attain this, the present invention generally comprises a board for supporting a user. The board has a top surface, a bottom surface, a front edge, a back edge, a first side edge and second side edge. Two pairs of elongate runners each have a tapered end portion. Each of the tapered end portions is turned upwards out of a plane of the runners. A pair of mountings mount the runners to the board. One pair of runners is located in front of a second pair of runners such that one of the runners from a front pair of the runners generally shares a longitudinal axis with one of the runners of a rear pair of the runners, wherein a front pair of runners and a back pair of runners are defined.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ski board apparatus apparatus and method which has many of the advantages of the ski boards mentioned heretofore and many novel features that result in a new ski board apparatus which is not anticipated, rendered obvious, suggested, or even implied by any of the prior art ski boards, either alone or in any combination thereof.

It is another object of the present invention to provide a new ski board apparatus which may be easily and efficiently manufactured and marketed.

It is a further object of the present invention to provide a new ski board apparatus which is of a durable and reliable construction.

An even further object of the present invention is to provide a new ski board apparatus which is susceptible of a low cost of manufacture with regard to both materials and labor, and which accordingly is then susceptible of low prices of sale to the consuming public, thereby making such ski board apparatus economically available to the buying public.

Still yet another object of the present invention is to provide a new ski board apparatus which provides in the apparatuses and methods of the prior art some of the advantages thereof, while simultaneously overcoming some of the disadvantages normally associated therewith.

Still another object of the present invention is to provide a new ski board apparatus for ski boarding down a slope.

Yet another object of the present invention is to provide a new ski board apparatus which includes a board for supporting a user. The board has a top surface, a bottom surface, a front edge, a back edge, a first side edge and second side edge. Two pairs of elongate runners each have a tapered end portion. Each of the tapered end portions is turned upwards out of a plane of the runners. A pair of mountings mount the runners to the board. One pair of runners is located in front of a second pair of runners such that one of the runners from a front pair of the runners generally shares a longitudinal axis with one of the runners of a rear pair of the runners, wherein a front pair of runners and a back pair of runners are defined.

Still yet another object of the present invention is to provide a new ski board apparatus that uses two pairs of skis for better stability and ease of use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic plan view of a foot holder of the present invention.

FIG. 4 is a schematic perspective view of the bracket of the present invention.

FIG. 5 is a schematic cross-sectional view taken along 5—5 of the present invention.

FIG. 6 is a schematic perspective view of the foot holder of the present invention.

DESCRIPTION OF THE PREFERRED EMBODIMENT

Figure 1:
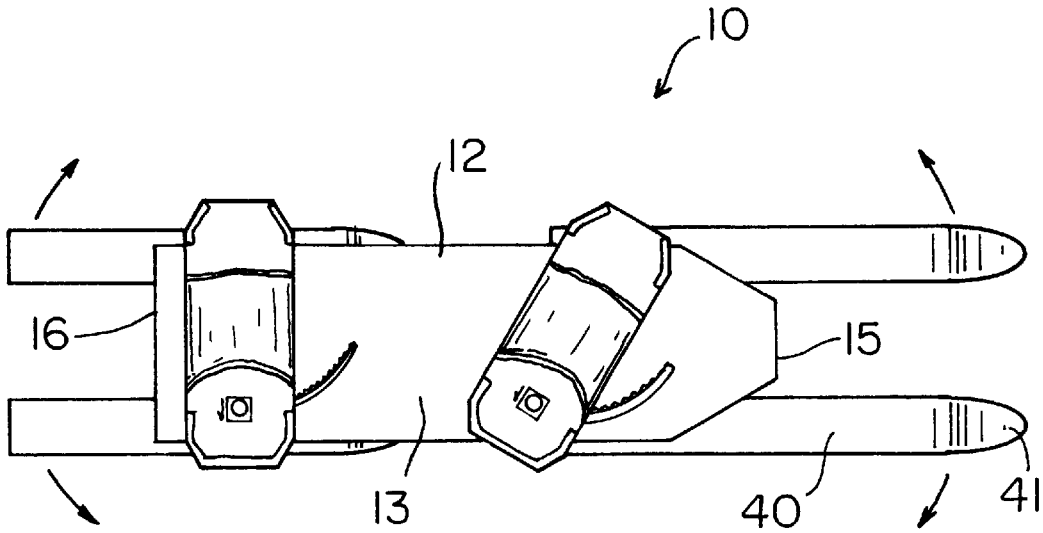
FIG. 1 is a schematic plan view of a new ski board apparatus according to the present invention.
Figure 2:
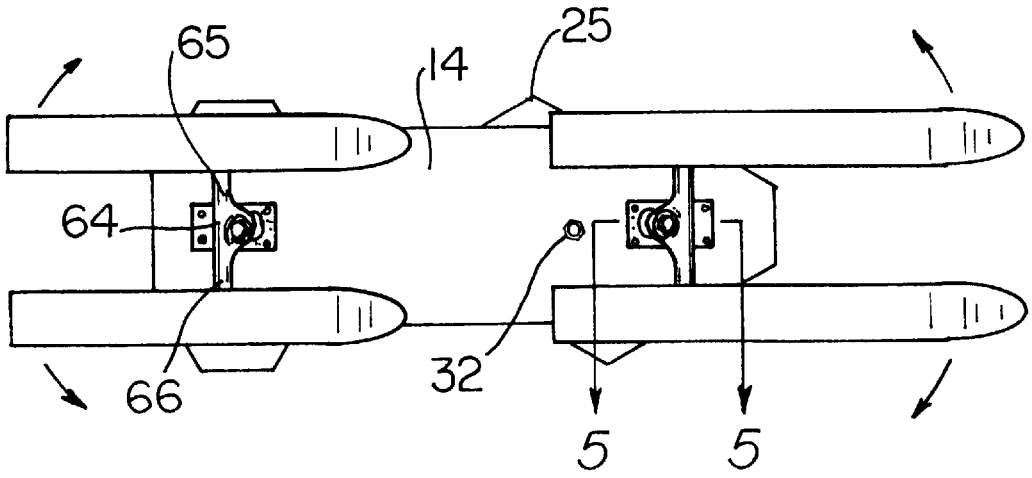
FIG. 2 is a schematic bottom view of the present invention.

With reference now to the drawings, and in particular to FIGS. 1 through 6 thereof, a new ski board apparatus embodying the principles and concepts of the present invention and generally designated by the reference numeral 10 will be described.

As best illustrated in FIGS. 1 through 6, the ski board apparatus 10 generally comprises a board for supporting a user. The board 12 has a top surface 13, a bottom surface 14, a front edge 15, a back edge 16, a first side edge 17 and second side edge 18. The portion of the board adjacent to the front edge is tapered such that the front edge has a width smaller than a width of the back edge of the board.

A pair of foot holders 20 hold the feet of the user to the board. Each of the foot holders has a base 21 portion. Each of the base portions has a front edge 22, a back edge 23, a top surface 24, a bottom surface 25 and a pair of opposite edges 26. A wall 27 extends upwardly from and is integrally coupled to the front 22 and back edges 23 for resisting movement of a boot rested on the top surface 24 of the base portion 21. Each of the foot holders 20 has a securing means thereon for securing the feet of a user in the foot holders. The securing means comprises a strap 28. The strap has a pair of opposite ends 29. Each of the ends 29 of the strap 28 is fixedly coupled to the top surface of the base portion. Each of the ends of the strap 28 are located generally adjacent to one of the opposite edges 26 of the base portion 21 such that the strap 28 extends across the top surface 24 of the base portion. The strap 28 is preferably made from elastic material.

A first bore 30 in each of the first and second foot holders 20 are for coupling the foot holders to the board 12. Each of the first bores is generally located in a central portion of the base portions of the first and second foot holders.

A second bore 31 is in each of the first and second foot holders. The second bores 31 are in the base portions 21 of the foot holders 20. The second bores 31 are located generally adjacent to the back edges 23 of the first and second foot holders.

A pair of bores 32 extend through the board 12. Only one filled with a pivot bar is seen for reasons which will soon be apparent. One of the bores is located generally adjacent to a back edge 16 of the board. The other of the bores is located generally adjacent to the front edge 15 of the board. Both of the bores are generally located along a longitudinal axis of the board 12.

A pair of pivot bars 33 allow the foot holders 12 to rotate with respect to the board 12. Each of the pivot bars 33 is mounted in one of the bores 32 in the board and in one of the first bores 30 in the first and second foot holders.

A pair of slots 35 in each of the boards 12 has a generally arcuate shape. Each of the slots 35 extend along a line forming a circle centered on the pivot bars 33. Each of the slots 35 has a side wall with a plurality of notches 36 therein. Each of the slots 35 is located generally adjacent to the first side edge 17 of the board 12. Ideally, each of the slots 35 has an angular measurement between one and two radians.

A pair of pawls 37 selectively engage the notches 36. Each of the pawls 37 is mounted in one of the second bores 31 of the first and second foot holders 20. Each of the pawls 37 is urged toward the notches 36 in the slots by a spring 38.

Two pairs of elongate runners 40 each have a tapered end portion 41. Each of the tapered end portions 41 is turned upwards out of a plane of the runners 40.

A pair of mountings 44 mount the runners to the board. Each of the mountings 44 has a saddle 45. The saddle is fixedly coupled to the bottom surface 14 of the board 12. The saddle 45 has a first bore 46 and a second bore 47. The second bore 47 is adapted for receiving a boss.

A yoke 50 has a central column 51 having an upper end 52 and a lower end 53. The upper end 52 forms a boss. The boss is inserted into the second bore 47 of the saddle 44. An arm 54 is fixedly coupled to and extends away from the central column 51. The arm 54 is located generally between the upper 52 and lower 53 ends of the central column 51. The arm 54 has a bore 55 therethrough. The bore 55 has an axis oriented generally parallel with a longitudinal axis of the central column 51. The lower end 53 of the central column has a bore 56 therethrough. The bore 56 in the lower end has an axis generally oriented perpendicular to the arm 54.

A pin 57 connects the yoke 50 to the saddle 45. The pin 57 has a distal portion 58 and a proximal portion 59. The distal portion 58 is threaded. The distal portion 58 is adapted to be releaseably inserted into the first bore 46 in the saddle 45. The pin's 57 proximal end 59 has a head thereon. The pin 57 is inserted through the bore 55 in the arm 54 of the yoke 50.

A pair of bearings 60 are on each pin 57. Each of the bearings is on one side of the arm 54 of the yoke 50. Preferably, each of the bearings 60 is made from elastomeric material.

A securing means holds the bearings 60 on the pin 57. The securing means is between one of the bearings 60 and the saddle 45. Ideally, the securing means is a nut 61.

A post 64 secures the yoke 50 to the runners 40. The post 64 has a first end 65 and a second end 66. The post 64 extends through the bore 56 in the lower end 53 of the central column 51.

A pair brackets 68 secures the post 64 to the runners 40. Each of the brackets comprises two plates 69, 70 fixedly secured to each other. The plates are generally oriented at a ninety degree angle towards each other. A first of the plates 69 of each of the brackets has a bore 71 therethrough for receiving an end of the post 64. A second 70 of the plates has a generally rectangular shape. The second plate 70 has four bores therein. Each of the bores is adjacent to a corner of the second plate.

A fastening means fastens the brackets 68 to the runners 40. The fastening means is inserted through the bores in the second plates and into the runners. The fasteners are preferably screws 72.

One pair of runners 40 is located in front of a second pair of runners such that one of the runners from a front pair of said runners generally shares a longitudinal axis with one of the runners of a rear pair of the runners so that a front pair of runners and a back pair of runners are defined. Tilting the board 12 causes the front pair of runners to be directed to one side of the longitudinal axis of the board and the back pair of the runners to be directed to the other side of the longitudinal axis of the board.

In use, the user places their boots in the foot holders 20 with the straps 28 around the boots. The user then glides down a slope and maneuvers by leaning one direction or the other. The boots can be adjusted to orient them into a comfortable position in relation to the board 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ski board device, said device comprising:

a board for supporting a user, said board having a top surface and bottom surface, said board having a front edge, a back edge, a first side edge and second side edge;

two pairs of runners, each of said runners being elongate, each of said runners having a tapered end portion, each of said tapered end portions being turned upwards out of a plane of said runners;

a pair of mountings for mounting said runners to said board;

wherein one pair of runners is located in front of a second pair of runners such that one of said runners from a front pair of said runners generally shares a longitudinal axis with one of said runners of a rear pair of said runners, wherein a front pair of runners and a back pair of runners are defined;

a pair of foot holders for holding the foot of the user to said board, each of said foot holders having a base portion, each of said base portions having a front edge, a back edge, a top surface, a bottom surface and a pair of opposite edges, each of said foot holders having a securing means thereon for securing the feet of a user in said foot holders;

a first bore in each of a first and a second of said pair of foot holders for coupling said foot holders to said board, each of said first bores being generally located in a central portion of said base portions of said first and second foot holders;

a pair of bores in said board, each of said bores extending through said board, one of said bores being located generally adjacent to a back edge of said board, the other of said bores being located generally adjacent to said front edge of said board;

a pair of pivot bars for allowing said foot holders to rotate with respect to said board, each of said pivot bars being mounted in one of said bores in said board and in one of said first bores in said first and second foot holders;

a second bore in each of said first and second foot holders, said second bores being in said base portions of said foot holders, said second bores being located generally adjacent to said back edges of said first and second foot holders;

a pair of slots in said board, each of said slots having a generally arcuate shape, each of said slots extending along a line forming a circle centered on said pivot bars, each of said slots having a side wall with a plurality of notches therein; and a pair of pawls for selectively engaging said notches, each of said pawls being mounted in one of said second bores of said first and second foot holders.

2. The ski board device as in claim 1, wherein said foot holders further comprise:

a wall extending upwardly from and integrally coupled to said front and back edges for resisting movement of a boot rested on said top surface of said base portion, said securing means comprising a strap, said strap having a pair of opposite ends, each of said ends of said strap being fixedly coupled to said top surface of said base portion, each of said ends of said strap being located generally adjacent to one of said opposite edges of said base portion such that said strap extends across said top surface of said base portion.

3. The ski board device as in claim 1, each of said mountings comprising:

a saddle, said saddle being fixedly coupled to said bottom surface of said board, said saddle having a first bore and a second bore, said second bore adapted for receiving a boss;

a yoke, said yoke having a central column having an upper end and a lower end, said upper end forming a boss, said boss being inserted into said second bore of said saddle, an arm being fixedly coupled to and extending away from said central column, said arm having a bore therethrough;

a pin for connecting said yoke to said saddle, said pin having a distal portion and a proximal portion, said distal portion being threaded, said distal portion adapted to being releaseably inserted into said first bore in said saddle, said pin being inserted through said bore in said arm of said yoke; and a pair of bearings, each of said bearing being on said pin, each of said bearing being on one side of said arm of said yoke, each of said bearings being made from elastomeric material.

4. The ski board device as in claim 3, wherein said lower end of said central column has a bore therethrough, said bore in said lower end having an axis generally oriented perpendicular to said arm;

a post for securing said yoke to said runners, said post having a first end and a second end, said post extending through said bore in said lower end of said central column;

a pair brackets for securing said post to said runners; and a fastening means for fastening said brackets to said runners.

5. A ski board device, said device comprising:

a board for supporting a user, said board having an top surface and bottom surface, said board having a front edge, a back edge, a first side edge and second side edge, a portion of said board adjacent to said front edge being tapered such that said front edge has a width smaller than a width of said back edge of said board;

a pair of foot holders for holding the foot of the user to said board, each of said foot holders having a base portion, each of said base portions having a front edge, a back edge, a top surface, a bottom surface and a pair of opposite edges, a wall extending upwardly from and integrally coupled to said front and back edges for resisting movement of a boot rested on said top surface of said base portion, each of said foot holders having a securing means thereon for securing the feet of a user in said foot holders, said securing means comprising a strap, said strap having a pair of opposite ends, each of said ends of said strap being fixedly coupled to said top surface of said base portion, each of said ends of said strap being located generally adjacent to one of said opposite edges of said base portion such that said strap extends across said top surface of said base portion, said strap being made from elastic material;

a first bore in each of said first and second foot holders for coupling said foot holders to said board, each of said first bores being generally located in a central portion of said base portions of said first and second foot holders;

a second bore in each of said first and second foot holders, said second bores being in said base portions of said foot holders, said second bores being located generally adjacent to said back edges of said first and second foot holders;

a pair of bores in said board, each of said bores extending through said board, one of said bores being located generally adjacent to a back edge of said board, the other of said bores being located generally adjacent to said front edge of said board, both of said bores being generally located along a longitudinal axis of said board;

a pair of pivot bars for allowing said foot holders to rotate with respect to said board, each of said pivot bars being mounted in one of said bores in said board and in one of said first bores in said first and second foot holders;

a pair of slots in each of said boards, each of said slots having a generally arcuate shape, each of said slots extending along a line forming a circle centered on said pivot bars, each of said slots having a side wall with a plurality of notches therein, each of said slots being located generally adjacent to said first side edge of said board, each of said slots having an angular measurement between one and two radians;

a pair of pawls for selectively engaging said notches, each of said pawls being mounted in one of said second bores of said first and second foot holders, each of said pawls being urged toward said notches in said slots by a spring;

two pairs of runners, each of said runners being elongate, each of said runners having a tapered end portion, each of said tapered end portions being turned upwards out of a plane of said runners;

a pair of mountings for mounting said runners to said board, each of said mountings comprising:

a saddle, said saddle being fixedly coupled to said bottom surface of said board, said saddle having a first bore and a second bore, said second bore adapted for receiving a boss;

a yoke, said yoke having a central column having an upper end and a lower end, said upper end forming a boss, said boss being inserted into said second bore of said saddle, an arm being fixedly coupled to and extending away from said central column, said arm being located generally between said upper and lower ends of said central column, said arm having a bore therethrough, said bore having an axis oriented generally parallel with a longitudinal axis of said central column, said lower end of said central column having a bore therethrough, said bore in said lower end having an axis generally oriented perpendicular to said arm;

a pin for connecting said yoke to said saddle, said pin having a distal portion and a proximal portion, said distal portion being threaded, said distal portion adapted to being releaseably inserted into said first bore in said saddle, said pin having a proximal end having a head thereon, said pin being inserted through said bore in said arm of said yoke;

a pair of bearings, each of said bearing being on said pin, each of said bearing being on one side of said arm of said yoke, each of said bearings being made from elastomeric material;

a securing means for holding said bearings on said pin, said securing means being between one of said bearings and said saddle, said securing means being a nut;

a post for securing said yoke to said runners, said post having a first end and a second end, said post extending through said bore in said lower end of said central column;

a pair brackets for securing said post to said runners, each of said brackets comprises two plates fixedly secured to each other, said plates being generally oriented at a ninety degree angle towards each other, a first of said plates of each of said brackets having a bore therethrough for receiving an end of said post, a second of said plates having a generally rectangular shape, said second plate having four bores therein, each of said bores being adjacent to a corner of said second plate;

a fastening means for fastening said brackets to said runners, said fastening means being inserted through said bores in said second plates and into said runners, said fasteners being screws; and wherein one pair of runners is located in front of a second pair of runners such that one of said runners a front pair of said runners generally shares a longitudinal axis with one of said runners of a rear pair of said runners, wherein a front pair of runners and a back pair of runners are defined, wherein tilting said board causes said front pair of runners to be directed to one side of said longitudinal axis of said board and said back pair of said runners to be directed to the other side of said longitudinal axis of said board.

6. A ski board device comprising:

a board for supporting a user, said board having a top surface and bottom surface, said board having a front edge, a back edge, a first side edge and a second side edge; two pairs of elongate runners, each of said runners having an upwardly turned and tapered end portion;

a pair of mountings for mounting said runners to said board;

wherein a front pair of runners is located in front of a rear pair of runners such that one of said runners from a front pair of said runners generally shares a longitudinal axis with one of said runners of a rear pair of said runners;

pair of foot holders for holding and removably securing a foot of the user to said board, each of said foot holders having a base portion, each of said base portions having a front and a back edge;

a first bore formed in each of a first and a second of said pair of foot holders for coupling said foot holders to said board, each of said first bores being generally located in a central portion of said base portions of said first and second foot holders;

a pair of bores formed in said board, each of said bores extending into said board, one of said bores being located toward said back edge of said board, the other of said bores being located towards said front edge of said board;

a pair of pivot bars for allowing said foot holders to rotate with respect to said board, each of said pivot bars being mounted in one of said bores in said board and in one of said first bores in said first and second foot holders;

a second bore formed in each of said first and second foot holders, each of said second bores being formed in said base portion of one of said foot holders, each of said second bores being located generally adjacent to said back of one of said first and second foot holders;

a pair of slots in said board, each of said slots having a generally arcuate shape centered on one of said pivot bars, each of said slots having a plurality of notches therein; and a pair of pawls for selectively engaging said notches, each of said pawls being mounted on one of said second bores of said first and second foot holders.

* * * * *